United States Patent [19]

Bravo

[11] Patent Number: 5,039,099

[45] Date of Patent: Aug. 13, 1991

[54] CHIP GAME APPARATUS

[76] Inventor: Roberto S. Bravo, 1585 Boyer Ct., Reno, Nev. 89503

[21] Appl. No.: 519,816

[22] Filed: May 7, 1990

[51] Int. Cl.[5] ..... A63F 3/00

[52] U.S. Cl. ..... 273/126 A; 273/128 R; 273/123 A; 273/2

[58] Field of Search ..... 273/126 R, 126 A, 127, 273/128 R, 128 A, 1 M, 2, 3 R, 123 R, 123 A, 108, 239

[56] References Cited

U.S. PATENT DOCUMENTS

| | | | |
|---|---|---|---|
| 3,547,443 | 12/1970 | Lacson | 273/126 R |
| 3,554,549 | 1/1971 | Grabowski | 273/128 R |
| 4,017,079 | 4/1977 | Apellaniz | 273/126 R |
| 4,146,228 | 3/1979 | Laciste | 273/126 R |
| 4,548,409 | 10/1985 | Cacho | 273/126 R |

FOREIGN PATENT DOCUMENTS

| | | | |
|---|---|---|---|
| 0664293 | 2/1988 | Switzerland | 273/126 R |

*Primary Examiner*—Edward M. Coven

*Assistant Examiner*—Raleigh W. Chiu

*Attorney, Agent, or Firm*—Leon Gilden

[57] ABSTRACT

An apparatus including a planar smooth playing surface, including a pocket formed at each corner of the playing surface, wherein a pocket is provided access by use of a displaceable door underlying each pocket. A predtermined number of cylindrical disks are awarded each player for directing each of said chips into an associated pocket by use of a primary or mother chip defined by a diameter greater than that of the playing chips. A modification of the instant invention includes utilization of dipole magnetic bars mounted to an upper surface of each chip, wherein opposing chips are permitted to deflect due to repulsion forces of the magnets, wherein each of the magnets includes a first and second pole, wherein each of the first poles of each of the magnets is positioned adjacent a peripheral wall surface of the chips or disks to permit the deflection effecting an enhanced level of difficulty in use of the instant invention.

1 Claim, 4 Drawing Sheets

PRIOR ART

CHIP GAME APPARATUS

BACKGROUND OF THE INVENTION

1. Field of the Invention

The field of invention relates to pool game type equipment, and more particularly pertains to a new and improved chip game apparatus wherein a plurality of players are awarded dissimilarly colored disks in an effort to direct an opponents disks into an associated pocket of the playing board surface of the instant invention.

2. Description of the Prior Art

The playing of the game of "pool" is old and well known in the art. The game is initially played in a variety of forums and accordingly requires relatively elaborate equipment to effect its proper play due to a requirement that the surface be of a relatively rigid and non-vibratory material requiring relatively large use of expensive material, such as slate and the like. The instant invention attempts to overcome deficiencies of the prior art by providing a billiard type table of limited bulk and less cumbersome permitting storage of the organization during periods of non-use. Examples of prior art devices may be found in U.S. Pat. No. 4,251,072 to Anthony provides a billiard type arrangement utilizing marbles directed within one of a series of six pockets about the surface of the playing board.

U.S. Pat. No. 499,073 to Williams sets forth a game apparatus wherein disk portions are projected towards receptive openings within a playing surface.

U.S. Pat. No. 3,881,727 to Olson sets forth a pool-type game utilizing disk markers for marking of a pocket on the pool table in which a last ball of a respective group has been deposited.

U.S. Pat. No. 1,943,697 to Schultz sets forth a game utilizing marble-like members directed within slots at an opposing end of an elongate playing surface.

U.S. Pat. No. 3,825,258 to Frierman sets forth a billiard-type game utilizing spheres positioned upon a playing surface for deposit within various pockets of the playing surface.

As such, it may be appreciated that there is a continuing need for a new and improved chip game apparatus wherein the same addresses both the problems of ease of use, as well as effectiveness in construction in avoiding bulky and cumbersome organizations and in this respect, the present invention substantially fulfills this need.

SUMMARY OF THE INVENTION

In view of the foregoing disadvantages inherent in the known types of pool game apparatus now present in the prior art, the present invention provides a chip game apparatus wherein the same provides a playing surface of limited bulk to permit directing of various chips of opposing players within pockets of the game surface. As such, the general purpose of the present invention, which will be described subsequently in greater detail, is to provide a new and improved chip game apparatus which has all the advantages of the prior art pool-type games and none of the disadvantages.

To attain this, the present invention provides an apparatus including a planar smooth playing surface, including a pocket formed at each corner of the playing surface, wherein a pocket is provided access by use of a displaceable door underlying each pocket. A predetermined number of cylindrical disks are awarded each player for directing each of said chips into an associated pocket by use of a primary or "mother" chip defined by a diameter greater than that of the playing chips. A modification of the instant invention includes utilization of bipole magnetic bars mounted to an upper surface of each chip, wherein opposing chips are permitted to deflect due to repulsion forces of the magnets, wherein each of the magnets includes a first and second pole, wherein each of the first poles of each of the magnets is positioned adjacent a peripheral wall surface of the chips or disks to permit the deflection effecting an enhanced level of difficulty in use of the instant invention.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved chip game apparatus which has all the advantages of the prior art pool-type games and none of the disadvantages.

It is another object of the present invention to provide a new and improved chip game apparatus which may be easily and efficiently manufactured and marketed.

It is a further object of the present invention to provide a new and improved chip game apparatus which is of a durable and reliable construction.

An even further object of the present invention is to provide a new and improved chip game apparatus which is susceptible of a low cost of manufacture with regard to both materials and labor, and which accordingly is then susceptible of low prices of sale to the consuming public, thereby making such chip game apparatus economically available to the buying public.

Still yet another object of the present invention is to provide a new and improved chip game apparatus which provides in the apparatuses and methods of the prior art some of the advantages thereof, while simultaneously overcoming some of the disadvantages normally associated therewith.

Still another object of the present invention is to provide a new and improved chip game apparatus wherein the same utilizes a plurality of groups of contrastingly colored chips for impact by a central chip to direct the playing chips into pockets and accordingly dispense an opposing player's chips into the pockets for conclusion of the game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
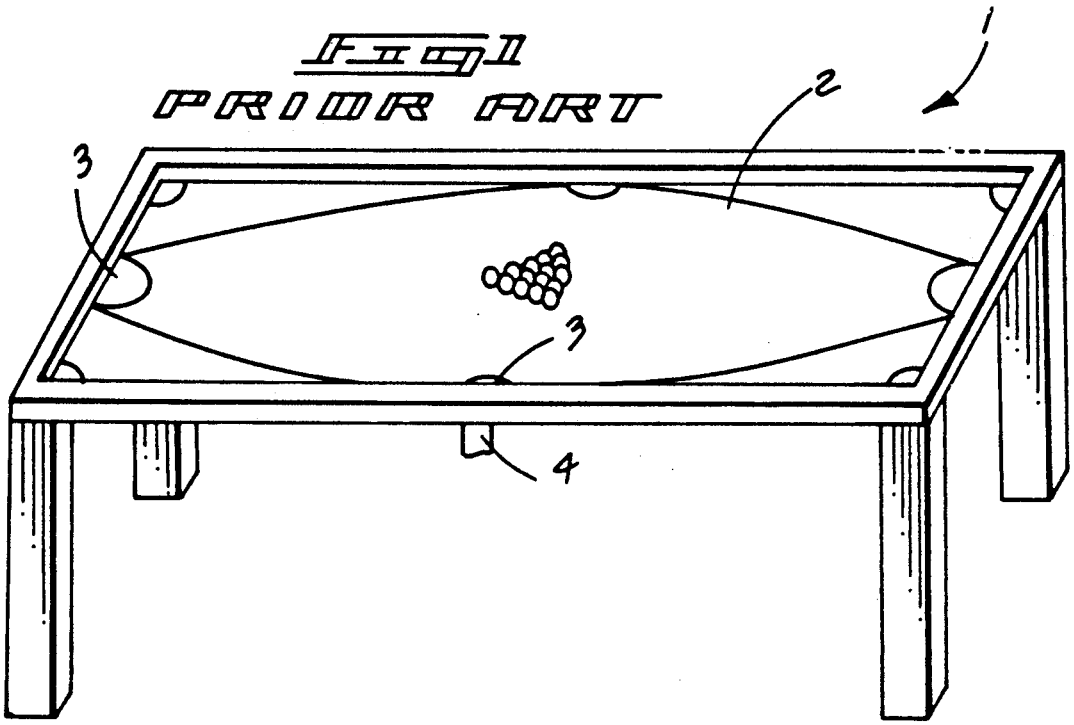
FIG 1 PRIOR ART
FIG. 1 is an isometric illustration of a prior art pool-type game.

With reference now to the drawings, and in particular to FIGS. 1 to 7 thereof, a new and improved chip game apparatus embodying the principles and concepts of the present invention and generally designated by the reference numeral 10 will be described.

Figure 2:
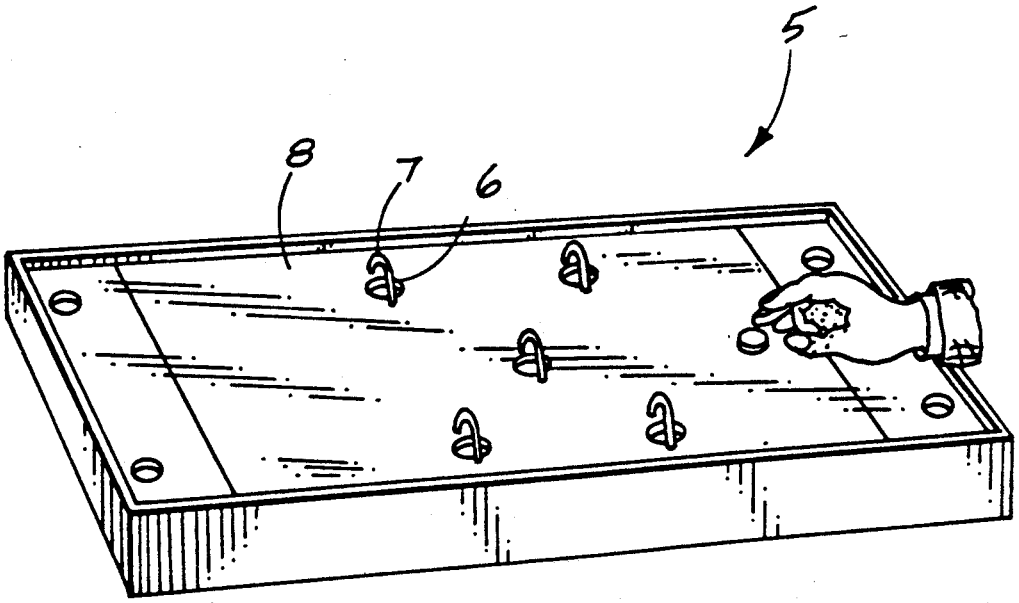
FIG. 2 is an isometric illustration of a prior art chip-type game.

FIG. 1 illustrates a prior art pool-type game 1, wherein a playing surface 2 includes a series of six pockets 3 distributed throughout the playing surface, wherein the pockets 3 include underlying basket members 4 to contain the spheres directed into the pockets. FIG. 2 illustrates a further prior art game 5 utilizing disks or chips manually manipulated throughout the playing surface 8 to be directed underlying hoops 7 into associated pockets 6.

Figure 3:
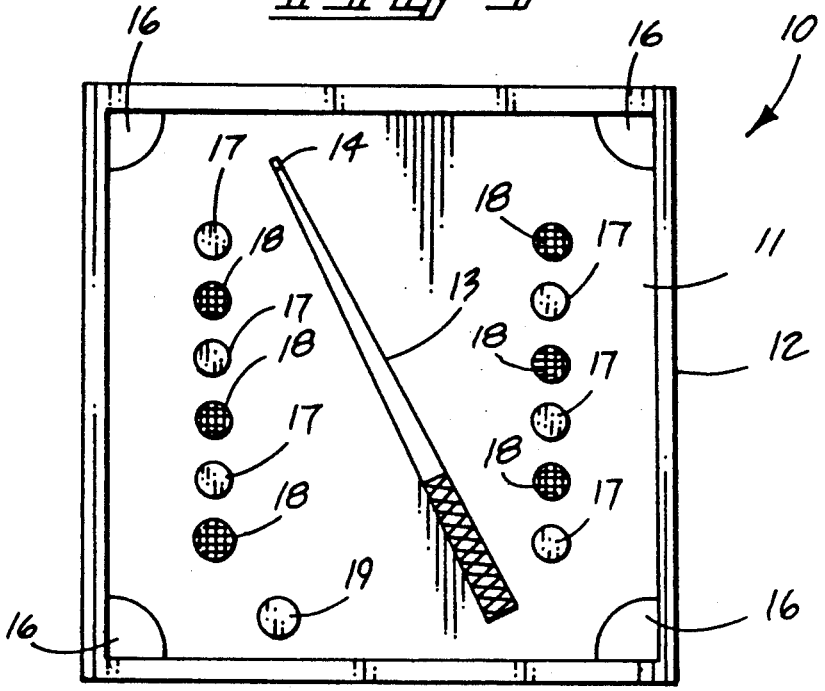
FIG. 3 is a top orthographic view of the instant invention.
Figure 7:
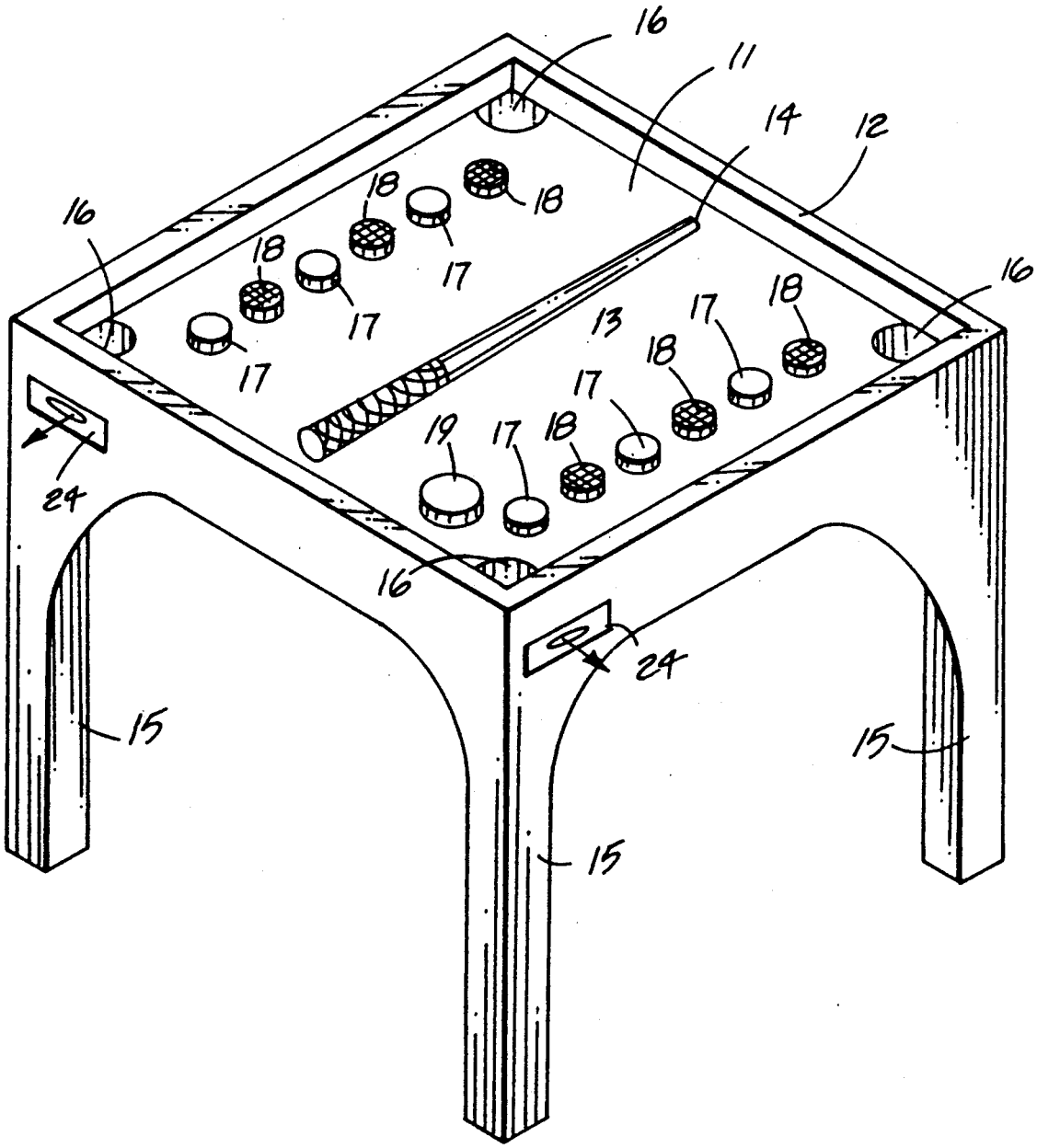
FIG. 7 is an isometric illustration of the playing table utilized by the instant invention and associated chips mounted thereon.

More specifically, the chip game apparatus 10 of the instant invention essentially comprises a rigid smooth planar playing surface 11, including a perimeter frame 12 extending above the playing surface, as illustrated in FIGS. 3 and 7. A conically elongate longitudinally aligned truncated cue stick 13 is provided, including a blunt forward end 14 orthogonally aligned relative to an elongate axis defined by the cue stick 13. The blunt forward end is spaced from a handle portion formed with a frictional engaging surface. The support surface and associated perimeter frame include a series of support legs 15 directed downwardly from the surface and framework defined thereby, wherein four of the legs 15 are directed downwardly from the rectangular or square configuration defined by the playing surface. The playing surface includes a recessed corner pocket 16 formed at each corner of the playing surface that extend within the playing surface to define a corner cylindrical arc to receive one of a plural series of disks 17 and 18. The disks are defined by first disk 17 and second disk 18, wherein the first and second disks are defined by a respective first and second coloration, such as white and black for contrast, and wherein each of the disks are defined by a first diameter. It is contemplated that six first and six second disks are awarded each player at the outset of each game, wherein a "mother" or "central" chip disk 19 is provided of a second diameter, wherein the second diameter is greater than that of the first diameter to geometrically distinguish the central disk relative to the first and second disks.

In play, each player attempts to direct an opposing player's disk into the associated pockets 16 utilizing the "mother" or central disk 19 to impact the opponents disk, and wherein the blunt end 14 of the cue stick 13 is directed into the "mother" or central disk to impact an opposing disk and direct an opposing into a receptive pocket 16.

Figure 4:
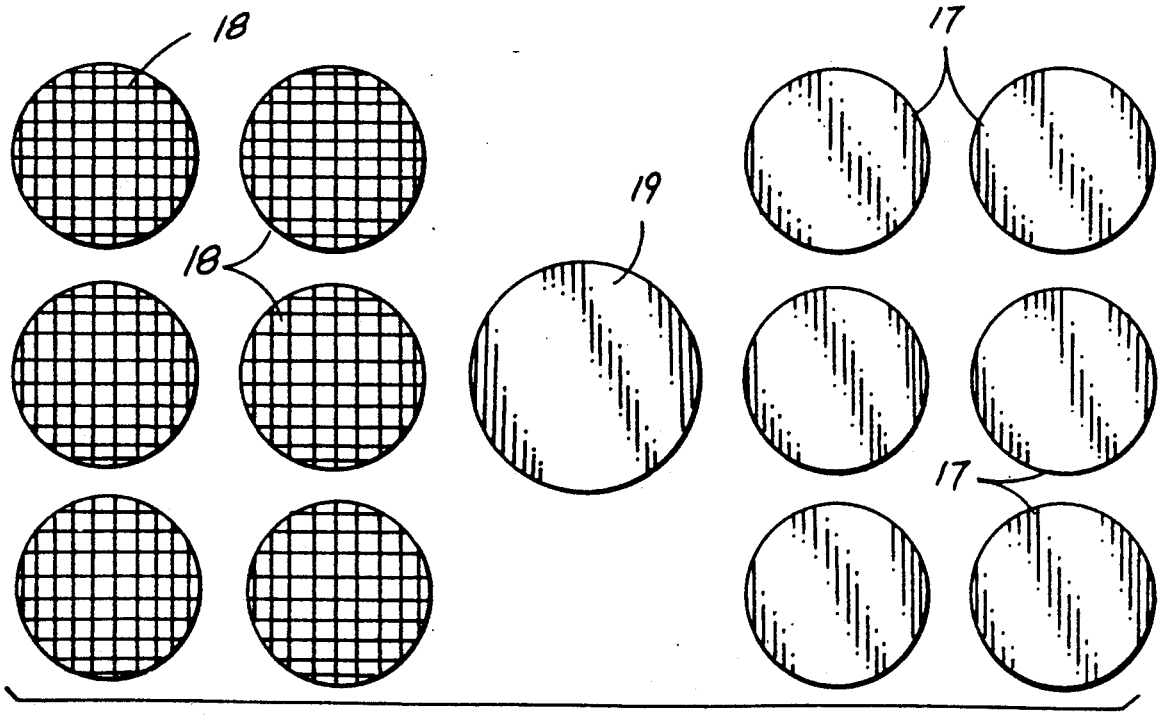
FIG. 4 is an orthographic top view of the chips or disks utilized by the instant invention.
Figure 5:
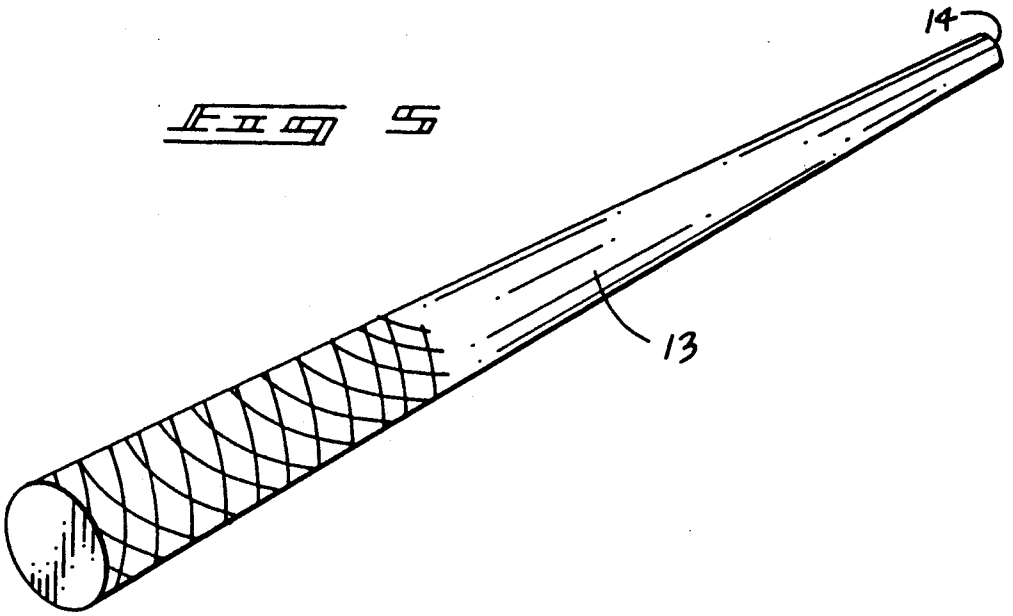
FIG. 5 is an isometric illustration of the cue stick utilized by the instant invention.
Figure 6:
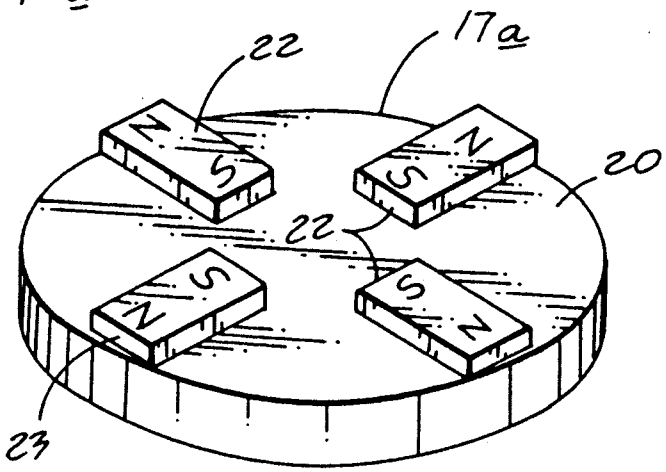
FIG. 6 is an isometric illustration of modified disks utilized by the instant invention.
Figure 6:
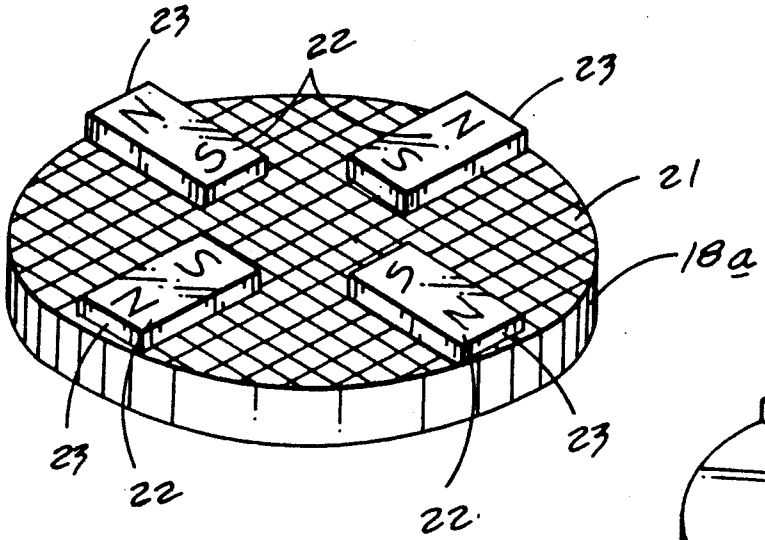

FIG. 6 illustrates a modification of the instant invention, wherein each of the modified first and second disks 17*a* and 18*a* respectively include a respective first and second top surface 20 and 21 respectively. Each of the top surfaces include a plural pair of bi-polar bar magnets 22 mounted thereon, wherein each of the bar magnets includes a forward and rear pole. The forward and rear poles are normally a north and south conventional magnetic pole arrangement, wherein a forward and rear pole are provided to merely set forth opposing categories of poles, i.e. each forward pole of a same north pole or a same south pole. Each forward pole 23 is positioned at ninety degrees relative to an adjacent forward pole of an adjacent bar magnet upon each respective top surface of each disk. The forward poles are positioned adjacent the cylindrical side wall of each disk. In this manner, the first and second modified disks 17*a* and 18*a* (again each player is awarded six such disks as noted and as illustrated in FIG. 4) to effect mutual deflection or repulsion of individual disks relative to one another. Accordingly in play of the game utilizing the apparatus of the instant invention, players may utilize individual disks to deflect relative to adjacent disks and in this manner, utilize various denominations of impacting trajectories to effect deposit of an opponents disk into an associated pocket 16. As illustrated in FIG. 7 for example, each of the pockets is associated with a removable drawer to permit removal of the disks from the respective pocket 16. Further, should a player inadvertently direct the "mother" or central disk into an associated pocket, that player immediately loses a turn and must reposition the central disk medially of the playing surface 11. Further, a player is permitted to position the "mother" or central chip or disk at least one-half inch away from the perimeter frame 12 to permit access utilizing the cue stick 13. Further, upon the aforenoted directing of the "mother" disk into one of the pockets 16, that player must replace one of that player's disk and position that player's disk immediately of the playing surface.

While the use of a rectangular playing surface is contemplated, the advantageous and preferred embodiment of the instant invention requires the use of a square playing surface to provide equal access to one of the pockets 16 positioned at the corner of the playing surface, as illustrated in FIGS. 3 and 7.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A chip game apparatus comprising, in combination, a playing surface, the playing surface defined by a rigid smooth surface, and the playing surface further including a perimeter frame extending above the playing surface, and a conically truncated cue stick, including a blunt forward end formed on the cue stick arranged orthogonally relative to a longitudinal axis defined by the cue stick, and a predetermined plurality of first disks and a predetermined plurality of second disks are provided and slidably positionable about the playing surface, and wherein the first and second disks are of a first diameter, and including a central disk, the central disk defined by a second diameter greater than the first diameter, and the central disk is arranged for receiving impact by the blunt surface of the cue stick to effect impact onto a first or second disk, and wherein the playing surface is defined by a square playing surface, and wherein the playing surface includes a pocket positioned at each corner of the playing surface in cooperation with the frame, the pocket including a corner cylindrical arc extending into the playing surface and defined by a spacing to permit reception of a selective first disk, a selective second disk, or the central disk within one of said pockets, and wherein each disk is defined of a cylindrical configuration, including a cylindrical side wall, and each disk includes a top surface, and each disk further includes a plural pair of bar magnets mounted on each top surface, and wherein each bar magnet is a bi-polar bar magnet, including a forward pole and a rear pole, and wherein each forward pole of each magnet is positioned adjacent the cylindrical side wall of each disk, and wherein each bi-pole of magnet is spaced ninety degrees relative to an adjacent bi-pole or magnet on each top surface of each disk.

* * * * *